US008269957B2

(12) United States Patent
Saban et al.

(10) Patent No.: US 8,269,957 B2
(45) Date of Patent: Sep. 18, 2012

(54) LASER BASED COUNTERMEASURES SYSTEM AND METHOD

(75) Inventors: Izhak Saban, Kiryat Haim (IL); Hanoch Miller, Nahariya (IL); Doron Even-Sturlesi, Timrat (IL)

(73) Assignee: Rafael—Armament Development Authority Ltd., Haifa (IL)

( * ) Notice: Subject to any disclaimer, the term of this patent is extended or adjusted under 35 U.S.C. 154(b) by 246 days.

(21) Appl. No.: 12/515,890

(22) PCT Filed: Nov. 13, 2007

(86) PCT No.: PCT/IL2007/001394

§ 371 (c)(1),
(2), (4) Date: Jan. 21, 2010

(87) PCT Pub. No.: WO2008/062401

PCT Pub. Date: May 29, 2008

(65) Prior Publication Data

US 2010/0126335 A1 May 27, 2010

(30) Foreign Application Priority Data

Nov. 21, 2006 (IL) ..... 179453

(51) Int. Cl.
*G01B 11/26* (2006.01)
*F41H 5/00* (2006.01)

(52) U.S. Cl. ..... 356/139.08; 89/36.01

(58) Field of Classification Search ..... 356/5.01, 356/139.08; 89/36.01; 235/404, 411; 250/203.2
See application file for complete search history.

(56) References Cited

U.S. PATENT DOCUMENTS

| | | | | |
|---|---|---|---|---|
| 4,173,414 | A | 11/1979 | Vauchy et al. | |
| 5,600,434 | A | 2/1997 | Warm et al. | |
| 5,793,512 | A * | 8/1998 | Ryu | 398/97 |
| 6,410,897 | B1 | 6/2002 | O'Neill | |
| 6,704,479 | B2 | 3/2004 | Koplow | |
| 7,064,817 | B1 | 6/2006 | Schmitt et al. | |
| 7,492,308 | B2 * | 2/2009 | Benayahu et al. | 342/52 |
| 2005/0065668 | A1 | 3/2005 | Sanghera et al. | |

(Continued)

FOREIGN PATENT DOCUMENTS

| | | | |
|---|---|---|---|
| EP | 1241486 | B1 | 9/2002 |
| GB | 2337172 | A * | 11/1999 |
| WO | 2004/109251 | A2 | 12/2004 |

*Primary Examiner* — Isam Alsomiri
*Assistant Examiner* — Antoine J Bedard
(74) *Attorney, Agent, or Firm* — Rothwell, Figg, Ernst & Manbeck, P.C.

(57) ABSTRACT

The present invention relates to a laser based system for protecting a platform against an armament equipped with an optical homing head element, that includes a command and control assembly equipped with an interface to a detection and acquisition system that detects and locates a threatening armament and receives from it a warning about the detection of said threatening armament combined with data relating to it; and a laser source operable by the command and control assembly in order to produce the required energy for jamming the optical head of the threatening armament; and wherein the system is characterized by that it includes in addition a sectarian array of a plurality of end units that are connected unto the laser source for selectively routing laser energy from the source to an end unit that was selected by the command and control assembly as the end unit that is best suited under prevailing conditions for pointing at the threatening armament and attacking it by emitting a laser beam in its direction.

20 Claims, 4 Drawing Sheets

U.S. PATENT DOCUMENTS

Figure 1:
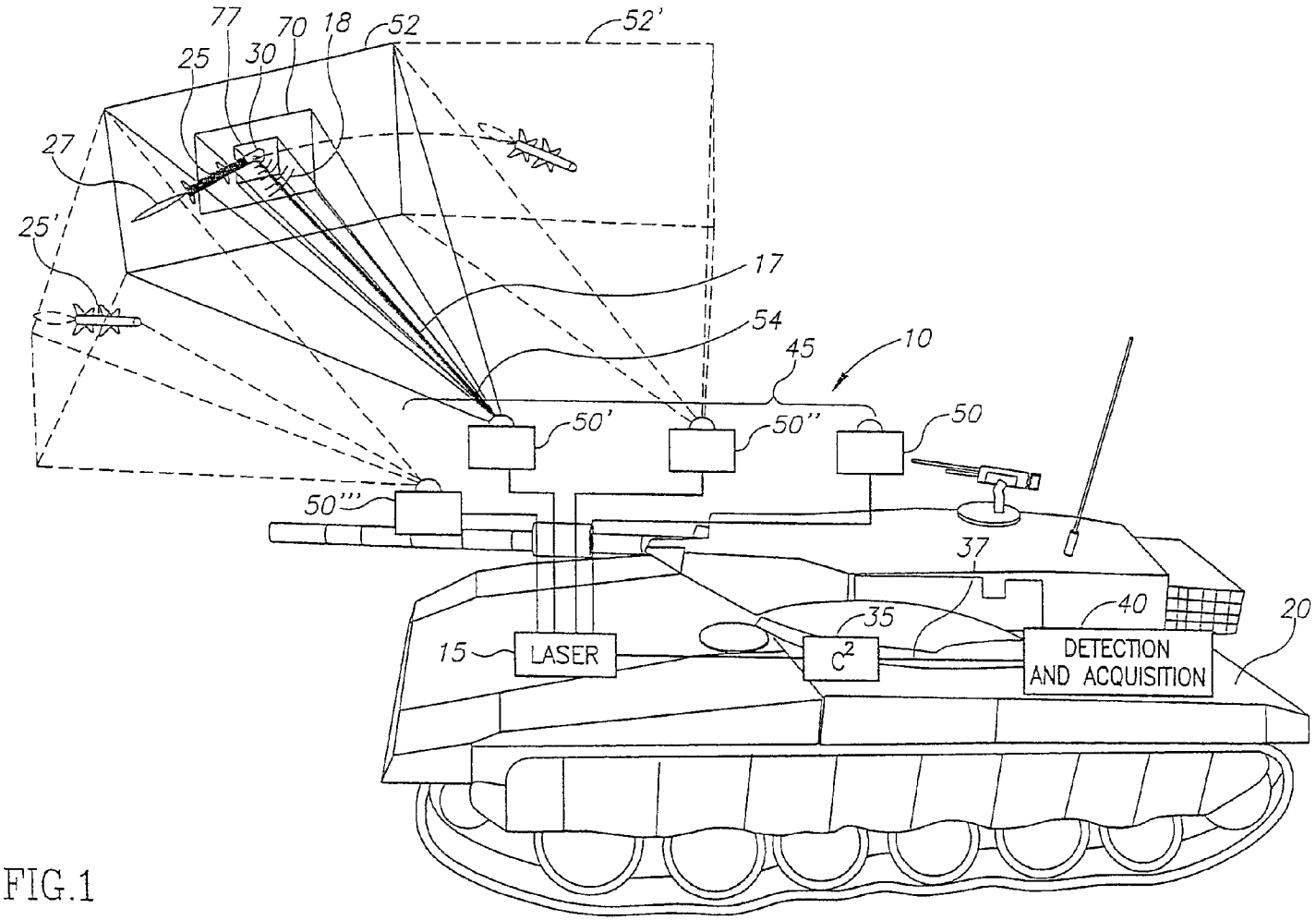

2006/0000988 A1* 1/2006 Stuart et al. ..... 250/504 R
2007/0075237 A1* 4/2007 Mills et al. ..... 250/239
2007/0201015 A1* 8/2007 Gidseg et al. ..... 356/29
2007/0205366 A1* 9/2007 Gidseg et al. ..... 250/348
2007/0206177 A1* 9/2007 Anschel et al. ..... 356/28
2007/0236382 A1* 10/2007 Dove ..... 342/14

* cited by examiner

LASER BASED COUNTERMEASURES SYSTEM AND METHOD

CROSS REFERENCE TO RELATED APPLICATION(S)

This application is a 35 U.S.C. §371 National Phase Entry Application from PCT/IL2007/001394, filed Nov. 13, 2007, and designating the United States. This application also claims the benefit of Israel Application No. IL-179453, filed Nov. 21, 2006, the disclosure of which is incorporated herein in its entirety by reference.

FIELD OF THE INVENTION

The present invention is within the framework of defensive systems providing protection from guided armament equipped with an optical homing head element in general and within the field known in the professional terminology as DIRCM (Directed Infra Red Countermeasure) in particular.

BACKGROUND OF THE INVENTION

Protective systems are well-known and in active use on many platforms (such as, for example, aircrafts, vessels, vehicles, tanks), as well as for protecting static installations (e. g. a guards post, industrial plants, warehouses) from those same kind of threats, namely attacks by guided armament equipped with an optical homing head (for example—a shoulder launched missile equipped with an infra red head, homing by locking on the heat radiated from the target—i. e. the engine of the platform (such as an aircraft) constituting a potential target).

Such systems are based on a carefully timed illumination, which is directional and accurate, provided by a radiation source—such as a laser system—and having at least one pre-tuned, encoded wavelength, aimed towards the guided armament equipped with an optical homing head element for jamming the optical element located at its head, e. g. blinding it, loading it by an over load of energy thus bringing it up to non-operating saturation, or at least degrading its operation so that it will be unable to detect the target and/or tracking it, diverting the guided armament to stray away from the target (thus reducing the threat it presented).

Thus, for example—

U.S. Pat. No. 5,600,434 describes an airborne pod, a replaceable container that contains, inter alia, a laser source—for jamming heat seeking homing missiles.

U.S. Pat. No. 6,410,897 describes a system and method for protecting aircrafts from threatening missiles, by employing a directional jamming device (for example, a laser system) that is mounted on a stabilized gimbaled platform. The system operates on a "step and staring" mode for performing its scanning operation of a sector in a wide field of view and looking for the threat.

U.S. Pat. No. 6,704,479 describes a fiber laser device that can be implemented for jamming missiles equipped with a homing head in the infrared range.

During the course of recent years, the term DIRCM (Directed Infra Red Counter Measure) has been a rooted household word in the terminology of professionals in this field for characterizing such protection systems against missiles equipped with an optical device in the infrared spectrum.

Such systems, described in the above cited various examples of prior art are prone to suffer from several drawbacks, for example they attribute a dedicated energy source to each jamming unit wherein the jamming unit is—by its nature—constrained to be effective only in a limited operation sector. A limitation created as a result of local masking by the presence of physical disturbances within close range from the jamming unit (e.g.—wherein the system is an airborne one—disturbances caused by the carrying aircraft fuselage).

In other words, in order to impart appropriate protection to the platform over an extended sector, systems of said prior art type required a whole set of energy sources (for example, several laser sources).

This—and more, the above cited prior art, does not treat the weak aspects of the protection systems, namely the necessity of maintaining a continuous tracking and examining the threatening armament in real time conditions, and this simultaneously while illuminating it using the countermeasures laser beam, in order to continuously evaluate the actual value of the threat posed by the specific armament.

Moreover, neither does it, according to the prior art, present the critical capabilities of producing control feedback and calibration (regarding the laser's output and its direction).

And finally, systems as operating in accordance with the prior art are based on a stabilized gimbaled arrangement, on which the majority of the systems' assemblies are mounted. Thus we are considering a cumbersome and sensitive structure that by the nature of this arrangement reduces the reliability of the systems and raises the level of required maintenance tasks during the system's lifetime.

Thus, at the time preceding the present invention, there definitely existed a need for a laser based system to provide protection against guided armament equipped with an optical homing head element, that would be of modular construction (from the aspect of its number of end units) but at the same time shall be based on a single energy source.

A protecting system that would enable to achieve tracking and examination of the threatening armament, providing real time performance, based on the optical reflections of the laser beam as they are continuously received from the potential threatening armament during its illumination while flying towards the protected platform.

A system that would include, in each of its end units, in an integral structure embedded means that would enable extracting control feed back and calibration (as it applies to the output of the laser and its sense).

A protection system equipped by an autonomous measurement and evaluation capabilities of the approaching threat's trajectory in order to evaluate the danger level of the specific advancing threat (for example, in cases of detecting and locating a plurality ("multiplied") threat cases in the relevant combat arena and the need to assign priorities and jamming responses energy).

In addition, it is required that the protecting system as said shall be reliable, rugged and capable to withstand inclement weather and environmental conditions, achieved by a marked reduction of the number of moving and stabilized assemblies installed in it.

SUMMARY OF THE INVENTION

The present invention attends to and answers all the requirements presented above (in the "Background of the invention" section). The system constitutes a laser based countermeasures system for protecting from threats presented by an armament equipped with an optical homing head element against the facility to be protected. The system includes an interface with a detection and acquisition system that detects the threatening armament and provides the initial capabilities of detection and acquisition of the potentially threatening armament. A control and command assembly integrated within the system, receives the warning alerting it to the detection of the potentially attacking armament and a laser source that is activated upon command from the command and control assembly to generate the required energy on time and in the adequate rate, in order to jam the operation of the optical homing head of the threatening armament.

A system in accordance with the invention is characterized by that it includes a sectorial array of a plurality of electro-optical end units that are connected with the laser source, in order to selectively route the laser energy from the laser source to an end unit selected specifically by the command and control assembly as being the most appropriate end unit, under the prevailing conditions, to perform tracking of the potential threatening armament while illuminating it with the laser beam.

In a system in accordance with the present invention, the tracking of the potential threatening armament while illuminating it with the laser beam is achieved by resorting to receive the optical energy that is reflected from the threatening armament and is subsequently received by an optical sensor that is installed in each of the end units.

On completing the tracking process the center of the Field Of View (hereinafter—FOV) of the end unit is continuously trained at the threatening armament. In a system in accordance with a preferred embodiment of the present invention, an optical assembly mounted in the end unit, is movable in a manner that it enables centering, in real time, the threatening armament appearance as it is received at the unit's sensor means towards the center of the end unit's sensor Field Of Regard (hereinafter—FOR).

When the continuous state of the tracking process is identified (i. e., the threat located in the end unit's center of the FOV), the system's command and control assembly actuates the laser assembly to illuminates the threatening armament with the laser energy. In a system in accordance with a preferred embodiment of the present invention, angular deviations, if occur between the laser beam direction and the end unit's sensor Line Of Sight (hereinafter—LOS), are compensatable in real time.

At this stage, illuminating for a given time slot and with appropriate coding, causes the disruption of the optical homing head mounted in the threatening armament. As the task of a DIRCM type system is to disrupt the operation of the optical homing head element of the threatening armament in such a manner, that missing by certain distance (i.e., of a satisfactory amount), as required in order to reduce the level of the threat, will be created and the threatening armament will miss the protected platform.

By an additional and different aspect, in a system according to the invention, the reflections of the laser beam from the threatening armament are received at the end unit that sent the beam to it. Based on the laser reflections, the command and control assembly generates data that enables tracking as well as studying the nature of the threatening armament in a manner that is much more efficient than in case of solely analyzing the attributes of the threat while relying only on the reception of the self emission energy from the threatening armament (for example, the thermal signature of its motor).

In yet another additional and different aspect, in a system according to the invention, in each of the end units there are integrally installed embedded command and control means that enable to generate control and calibration feedback data (relating to the output and the direction of the laser).

In one more additional and different aspect, in a system according to the invention, the command and control assembly enables independent measurement and evaluation of the trajectory of the threatening armament, in order to evaluate in real time the current degree of the threat due by the specific armament, (for example, in situations in which the detection and acquisition system detected a plurality of threats in the relevant arena and hence there exists a critical need for setting priorities and appropriate assignment of the jamming energy).

In another and different aspect of a system in accordance with the invention, the end units are ruggedly constructed and therefore able to withstand severe environmental conditions, by selecting a substantial reduction of the number of moving and stabilized assemblies making up the system and mounted in it.

BRIEF DESCRIPTION OF THE ACCOMPANYING FIGURES

The present invention will be described herein in conjunction with the accompanying Figures. Identical components, wherein some of them are presented in the same Figure—or in case that a same component appears in several Figures, will carry an identical number.

FIG. 1 constitutes a schematic illustration of an arena of activity of one example of a system in accordance with the present invention.

Figure 2:
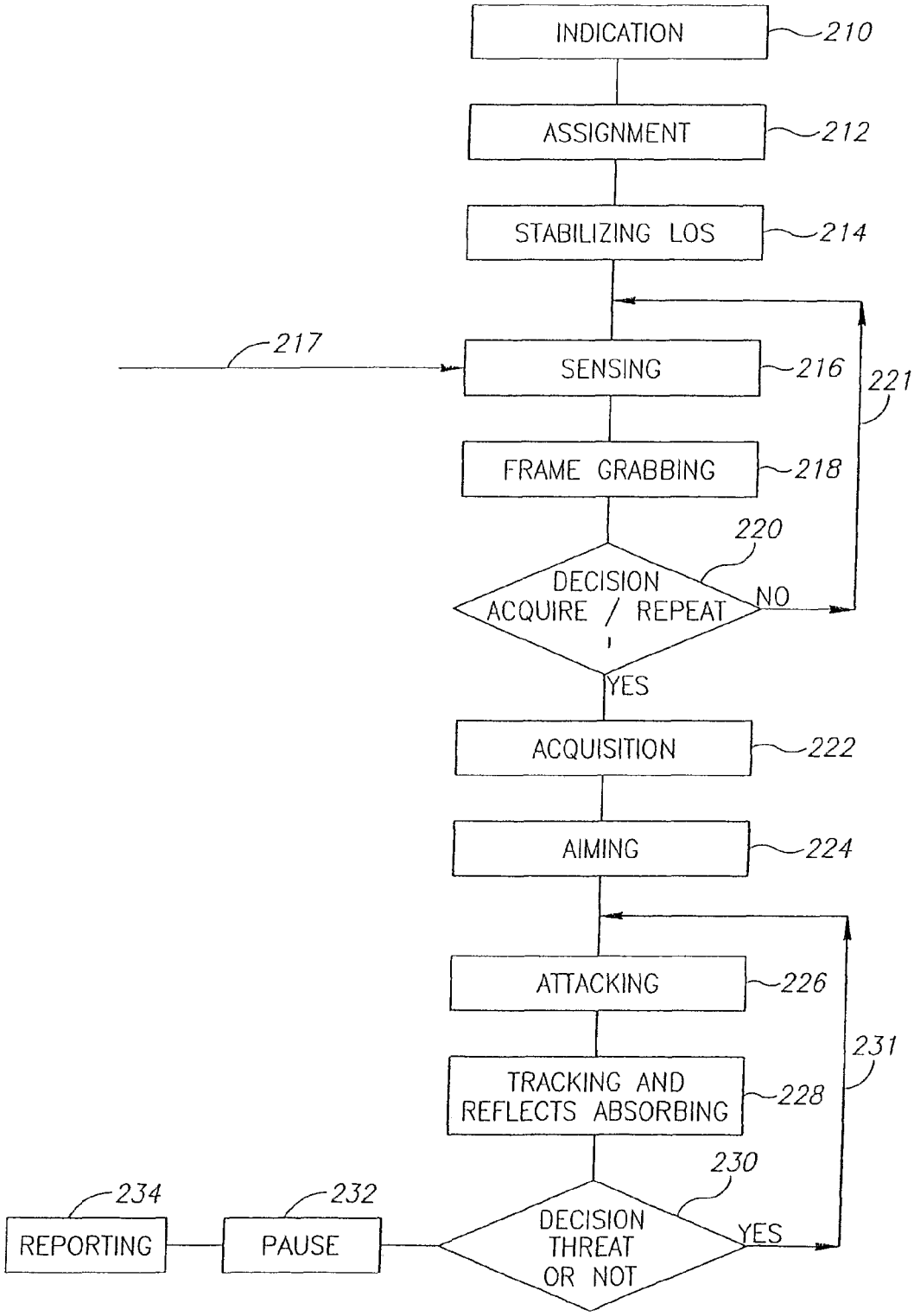

FIG. 2 constitutes a flow chart type of diagram that describes the operation logic of a system in accordance with the present invention whose operation arena is depicted in FIG. 1.

Figure 3:
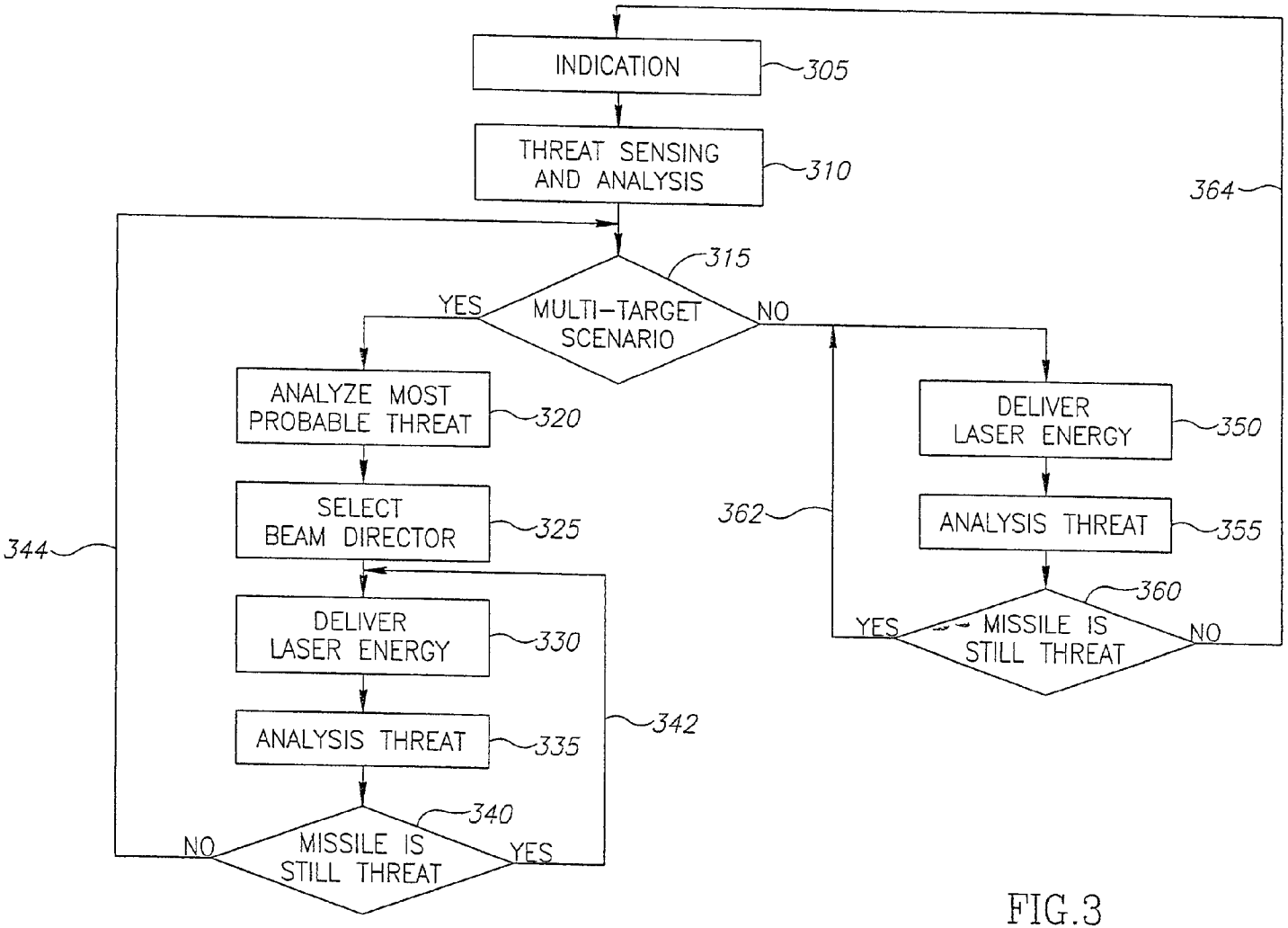

FIG. 3 constitutes a flow chart type of diagram that describes the operation logic of a system in accordance with the present invention, while operating in a multi-threats scenario.

Figure 4:
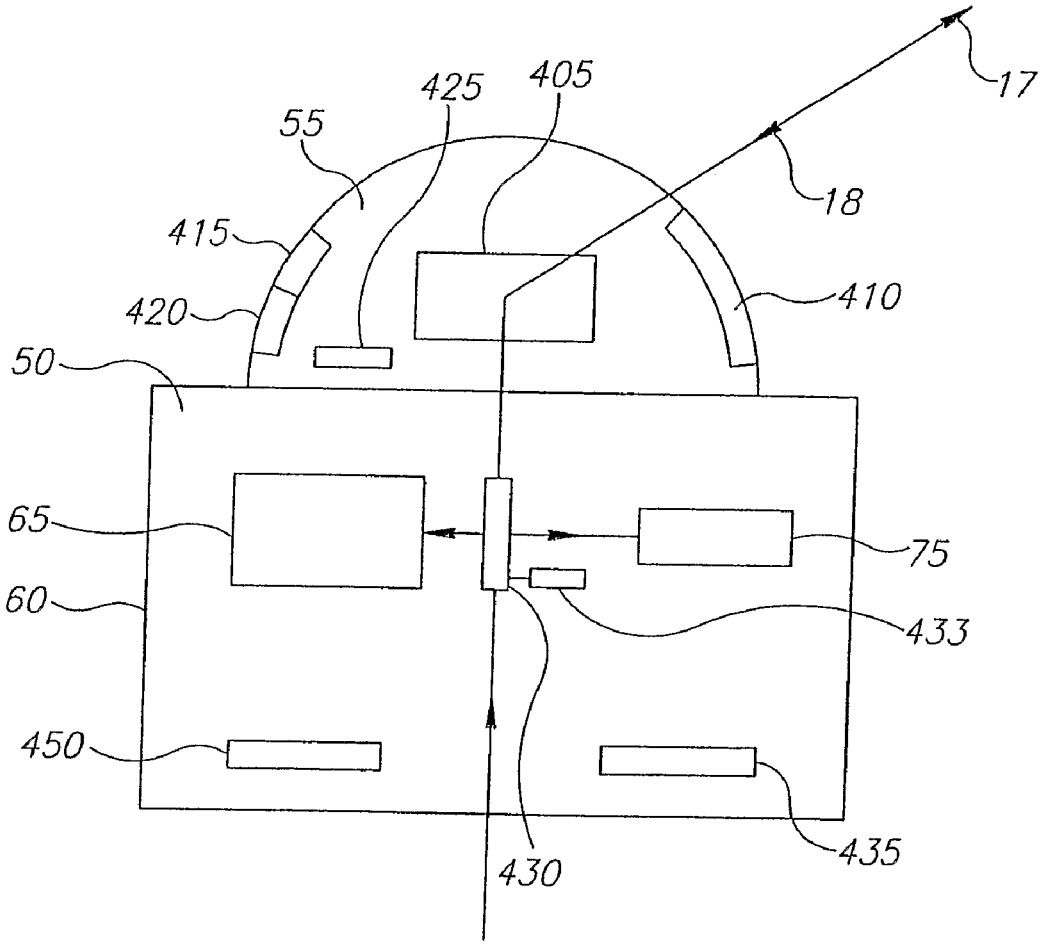

FIG. 4 constitutes a schematic illustration of an end unit in a system whose arena of operation and its operation scheme are depicted in FIGS. 1 and 2, respectively.

DETAILED DESCRIPTION OF A PREFERRED EMBODIMENT OF THE PRESENT INVENTION

Reference is being made to FIG. 1. FIG. 1 constitutes a schematic illustration of an arena of activity of one example of a system—10, in accordance with the present invention.

At this stage it is appropriate to state that the present invention would be described herein after by referring to a system 10, that is based on a laser type source of energy, for defending a platform that is (in our selected example) a combat tank 20, against threatening armament equipped with an optical homing head element such as a missile 25 with an optical homing head 30, but this is used only as an example. Any professional experienced in this field would appreciate that the invention as described hereinafter with reference to the accompanying figures is also applicable to systems that are based on a different energy source (for example, a powerful projector in the visible spectrum) or to systems that in addition to activating energy based jamming means, or as replacement to it—use other types of means and different jamming measures—or as an alternative to the above approach, resort to other totally different type of jamming means (for example a smoke screen, decoy launching etc.) and of course might also be used for other types of potentially endangered platforms (for example, an aircraft, a helicopter, a vessel or also static targets such as a post or a radar installation). A system in accordance with the invention, can as well serve for defending myriad of other platforms against variety of threats such as armaments equipped with electro-optical homing heads of other and different types than those cited hereinafter above (for example—protection of aircrafts from threats such as ground to air missiles equipped with an infrared homing head, or another example—protecting a command or guards post from an electro-optically guided air to ground missile).

A system 10 constitutes, as said, a laser based system for protecting against armament equipped with an optical homing head element.

This system 10 includes a command and control assembly 35. Any professional would understand that the command and control assembly 35 is a computer-based assembly.

Command and control assembly 35 has an interface 37 with a detection and acquisition system 40.

The detection and acquisition system 40 detects the threatening armament and relays to the command and control assembly 35 the warning indication advising the fact of detecting the threatening armament combined with supplying data about it.

Any professional experienced in this field would understand that the detection and acquisition system 40 constitutes a system based on sensors (for example—radar), wherein the data that it transfers might include—in its minimal level, only the direction of the threatening armament, and under different state also the location of the threatening armament or even also its flying course. These dada might be given in reference to the axes of system 10 or as referred to an inertial axes system.

Any professional experienced in this field would understand that that the detection and acquisition system must not necessarily be mounted on the same platform on which the rest of the system's components are installed. In a decentralized operating model, as any professional would understand, the detection and acquisition system 40 might be located on one platform that provides indication through using a data communication channel (for example, wireless communication) to another platform—the one that is being threatened by the threatening armament that is moving towards it.

System 10 includes, as said, a laser source 15 that is operated by the command and control assembly 35 in order to generate the required energy for jamming the threatening armament optic homing head.

System 10 is characterized by that that it includes a sectorial array 45 of several (actual a plurality) of end units 50. All these end units 50 are connected to laser source 15 for selectively directing the laser energy of the laser from source 15 to the end unit that was selected by the command control assembly 35, as the unit that best fits—in accordance with the prevailing conditions at that time, for pointing at the threatening armament 25 and illuminating it by emitting laser beam 17 towards it (in the illustrated example, the end unit that was selected, was assigned number 50').

Laser energy conduction from the source (15) to an end unit 50 might be accomplished through using one from several available electro optic technologies. Examples are—an optic relay and fiber optics. Any professional experienced in this field would understand that each technology—naturally, would have its advantages and its drawbacks—considering the aspects of energy power levels, of withstanding inclement environmental conditions and the like. Hence, selection of the laser energy conduction configuration is performed by relating to the intended application and the type of the platform carrying the system.

The number of end units 50 that would be incorporated in the system is established, eventually, subject to the angular range of each one of them in azimuth and elevation. End units 50 are supposed to provide the required angular coverage from which the threatening armaments (aiming to harm/destroy the platform), i. e. cover the source of attack (which the system is supposed to protect).

A specific Field Of Regard (hereinafter—FOR) 52 is assigned to each end unit 50, of at least 10° in azimuth and in elevation. In accordance with a command from the command and control assembly 35, end unit 50 can move its Line Of Sight (hereinafter—LOS) 54, to any selected direction within the unit's FOR—and this in terms of relative motion (in relation to the base of end unit 50) or as said, routing it in an inertial coordinates system's direction (vector).

All end units 50 include (and see also FIG. 4)—an optical assembly 55 that is angularly directed and meant to direct the LOS unto the threatening armament in order to perform two tasks: (i) receiving the energy radiated from the threatening armament during its flight in order to provide detection, acquisition and tracking during the stages of accurate guidance of the LOS at the period platform vs. threatening armament relative motion and (ii) aiming the laser beam 17 unto the threatening armament and receiving the optical reflections 18 from it.

End unit 50 includes as well a static assembly 60 that is connected to optical assembly 55. Static assembly 60 includes first sensor means 65 for sensing the threatening armament. As will be elaborated hereinafter, first sensor means 65 serves for monitoring sector 70—the FOV of first sensor 65, at which the threatening armament is anticipated. Static assembly 60 includes inter alia also a second sensor means 75 for "shooting" the optical reflections 18 from the threatening armament (as these reflections are returned from the threatening armament after it has been illuminated by laser beam 17).

Any experienced professional would understand that in operation—the data passed on by the detection and acquisition system 40 enable to start the detection and acquisition processes by end unit 50. The data might include—in their minimal level—only the direction sense of the potentially threatening armament and in other circumstances also the location of the threat or even its flight trajectory. The data might be referenced to the axes of the system 10 or as referred to an inertial axes system.

In any case the data transferred from the detection and acquisition system 40 would enable detecting the threat within the FOV of first sensor means 65 (mounted in end unit 50), and this after the command and control assembly 35 selected the same end unit as best fit for search and detection of the threatening armament found inside sector 70 that was assigned to it. In the initial stage, the scenery from the general spatial direction 70, as it was received from detection and acquisition system 40, is projected unto sensor means 65.

Outputs of sensor means 65 are routed to the command and control assembly 35. The command and control assembly start to conducts a search for the threatening armament at the center of the FOV of sensor means 65.

On completing the detection process in the sectorial space 70, acquisition of the threatening armament is performed and the tracking stage follows—commands form command and control assembly 35 are given to mobile mechanisms (motors and etc.) mounted in end unit 50, in order to maintain the threatening armament at the center of the FOV of sensor means 65 (these mechanisms are not shown in FIG. 1).

Any experienced professional would understand that the FOR 52 of each end unit 50 in the system, could be in the range of tens of degrees (e.g. 20-90 degrees) in both azimuth and elevation, while the FOV 70 of first sensor means 65 is only a few degrees. It is therefore possible to vary the direction of the FOV of sensor means 65 in the FOR of end unit 50 by suitable commands sent by the command and control assembly 35.

When a warning is given, the system trains the center of the FOV of first sensor means 65 of the specific end unit 50 that has been selected, to the direction from which the threatening armament is anticipated to arrive while emitting its detectable self radiation. This discharge might be (for example) thermal radiation 27 from the motor of the threatening armament 25 and/or from its body.

Any professional in this field would understand that the process of searching for a threatening armament constitutes a critical step before advancing to the stage of illuminating it with the laser beam. The process of detecting the threatening armament relies on well-known technologies of image processing in which an effort is made to detect the potential threatening armament that possesses kinematics, dynamic and energetic properties (characteristics) that fit specific type of threatening armament.

The search process for the threatening armament is generally performed within a short time frame, and in general while processing integrated items of the outputs of sensor means 65 with data from inertial equipment that might be located in end unit 50. The inertial equipment and the gages that are located in the movable optical assembly 55 provide the spatial inertial direction of the LOS of first sensor means 65 (the inertial equipment and the gages are not illustrated in FIG. 1).

The command and control assembly 35 processes the information that was received from first sensor means 65 in the form of several frames, and this in order to arrive at a highly reliable decision about the existence of the threatening armament within the scope of first sensor means 65.

In addition, in case there exists new updated and available information, the detection and acquisition system 40 relays these data to the command and control assembly 35 that respectively updates the relevant end unit 50 (the one suiting the spatial direction (and/or location) in which the threatening armament is found). Control mechanisms in end unit 50 are updating, simultaneously, the momentary observation direction of sensor means 65.

The detection process is a preliminary step (process) before the illumination by the laser action starts. In case the target was not detected in the FOV of sensor means 65, the command and control assembly 35 passes orders to start the scanning stage around a central direction that has been defined by the detection and acquisition system 40. Scanning process is executed at least in on of the axes (azimuth and elevation), in a manner that would enhance the probability of successfully terminating the process of detecting the threatening armament.

In case the detection process of the threatening armament succeeded, then—as said, the system is switching to the acquisition stage (in which "holding the target" is performed). At the end of the successful acquisition process—the system switches over to the tracking stage in which the threatening armament is located at the center of sensor means 65 field of view.

As illustrated in FIG. 1, the energetic center of the laser beam 17 also coincides (from the angular aspect) with the center of sensor means 65's FOV. Thus, when the suitable order to activate laser 15 is issued by command and control assembly 35, the laser beam 17 would hit exactly the space location to where the center FOV of sensor means 65 is aimed.

With the information produced by sensor means 65 at the commencement of the tracking (namely, the existence of a threatening armament at the center of the FOV) it is possible to actuate laser source 15. Note that one of the characteristics of a system that would be implemented in accordance with the invention is the activation—in addition—of a second sensor means 75 that has a narrower FOV—77, in comparison to that of sensor means 65.

In accordance with a preferred embodiment of the invention, all the axes of line of sight of all the various optronic means integrated in end unit 50 consolidate together. Namely, the center of the FOV of first sensor means 65 is required to converge with the center of the FOV of second sensor means 75, and the center of the FOV of first and second sensor means 65 and 75 coincides approximately with the energetic center of laser beam 17 that is produced by laser source 15.

As was explained above, the center of the FOV of sensor means 65 coincides with the center of the FOV of sensor means 75. Hence, obviously, as for a system in accordance with the invention that is operating in the stage of tracking a threatening armament (using sensor means 65); the threatening armament would also be, approximately, at the center of the FOV of sensor means 75.

As a consequence, it is also feasible to switch over to tracking mode by exploiting the outputs received from second sensor means 75.

The advantage gained by resorting to use also second sensor means 75 stems from the higher tracking accuracy provided by it, and also the outcome of operating under varying conditions. Sensor means 65 has the capability to receive the self-emissions of the threatening armament. Moreover, at the time that the laser source 15 is activated, sensor means 75 is suited to receive the returning reflected laser signals 18 from the threatening armament. Once again, in consequence, as said, the quality of the tracking is better and positive as it applies to the illumination that would be radiated by the laser.

Thus, the existence of a tracking mechanism based on the reflections of the laser beam from the threatening armament enables—in a system in accordance with the invention, to extract the characteristics of the threatening armament in a better manner in comparison with systems based on the prior knowledge, as quoted.

Extracting the features of the threatening armament based also on the laser beam' reflections from it—culminates, in achieving better indications regarding the status of the threatening armament and to evaluate its operational mode. This information is highly needed for deciding when to terminate the laser's illumination cycle.

Reference is being made now to FIG. 2. This figure constitutes a flow chart type of a diagram that describes the operation logic of system 10 in accordance with the present invention, whose operation arena is depicted in FIG. 1.

In stage 210, a specific indication is received at the command and control assembly 35 (and see above when referring to FIGS. 1 and 3)—this indication is arriving from the detection and acquisition system 40, warning about the presence of a threatening armament 25 in the system's arena, indicating also the direction of the threat in relation to the axes of end units array 50 and to an inertial coordinates system.

Any professional in this field would understand that detection and acquisition system 40 might provide also a several warnings alerting the presence of several targets in the covered arena, one warning or more, at the time that system 10 is already engaged in operation against a threatening armament.

In stage 212, the command and control assembly 35 assigns the selected end unit 50' to the threatening armament. At this stage, the optical LOS of optical assembly 55 is established and aimed towards the threatening armament. At this time and based on the directional data received from the detection and acquisition system 40, first sensor means 65 of optical assembly 55 is activated.

In stage 214 the LOS of sensor means 65 is stabilized and updated towards the threatening armament.

During stage 216 sensor means 65 is performing continuous sensing of the chosen scenery within sector 70. Simultaneously, while shooting the scenery, the command and control assembly 35 might continue to provide updated information pertaining to the current location of the threatening armament while correcting and updating the LOS of optical assembly 55 unto it (see input 217).

Now in stage 218 frame grabbing of the picture frames is performed from sensor means 65 in a manner that enables the command and control assembly 35 to perform extraction and analysis of the characteristics relating to the phase of the threatening armament as received in the frames of the scene, while utilizing known methods of computerized image processing (any professional in the field would appreciate that each grabbed frame is stamped or in other word—tagged with the time and inertial data as provide by the end unit's inertial equipment and gages).

In stage 220, the command and control assembly 35 arrives at a decision based on the above cited frame grabbing (218) by the extraction and analysis of the characteristics relating to the phase of the threatening armament and with implementation of "a decision logics"—one that any experienced professional is familiar with—whether to assign to the threatening armament the significance of a target that has to be acquired and tracked as required in case of attacking armament, wherein then stage 222 (to which we will refer below) is realized or alternatively—additional frames of the arena are required wherein the system reverts back to stage 216 (see path 221 in FIG. 2).

In stage 222, that is implemented after the command and control assembly 35 arrived at a decision that it is dealing with a threat which is a target that should be illuminated, transition of end unit 50 materializes to the state of acquisition and tracking the threatening armament in accordance to its characteristics.

In stage 224, aiming the LOS of optical assembly 55 towards the threatening armament is accomplished, in a manner that enables centering the threatening armament appearance as it is received in accordance with the outputs from sensor means 65 and processed by the command and control assembly 35. At this state, activating second sensor means 75 for sensing the optical energy of the threatening armament enables the system to improve the accuracy of the tracking (in comparison with the accuracy obtained when only sensor means 65 is used). At the end of the aiming (routing) of the LOS is concluded, either by sensor 65 alone and/or combined with outputs of the second sensor, namely sensor 75, and the end unit 50 is adjust and tuned towards the threatening armament.

In stage 226, the threatening armament is attacked by the laser beam illumination, wherein command and control assembly 35 directs the laser energy towards end unit 50'. The command and control assembly also determines the nature of the lasing beam in accordance with the known information (so far) about the characteristics of the threatening armament. For example, the laser beam might include a plurality of wavelengths wherein each of them might also be a modulated one.

At Stage 228 continuous tracking of the threatening armament is performed. This stage may be conducted by first sensor 65 alone but in case that a second sensor 75 exists as well then it also contributes to achieving a better/enhanced performance.

As said, if second sensor means 75 does exist in the end unit, then it is also adapted to receive the laser reflections from the threatening armament and contributes for the improvement of the aiming of the laser beam (at that instant) in the direction of the threatening armament. In this manner, higher efficiency is gained from the action of the laser beam that is aimed at the threat.

The second sensor means 75 for sensing the laser reflections from the threatening armament might be connected with an additional sensor means—in order to obtain additional properties relating to the threatening armament. From the reflections at least one of the relevant data might be extracted, as for example the momentary range between the platform and the target, the velocity of the threatening armament, angles of the trajectory/path of the threatening armament in relation to the system, variations of the angular rate of the threatening armament—and a datum of the intensity of the optical reflection from the threatening armament.

Any professional experienced in this field would understand that in accordance with these data, command and control assembly 35 is capable to generate additional up to the minute information relating to the degree of threat posed by the illuminated threatening armament at each and every given minute (by re-evaluating its anticipated trajectory), and also continue to aim the laser beam towards the front end of the threatening armament (wherein its optical element that is susceptible to be damaged when attacked by the laser is located).

In stage 230, the command and control assembly 35 arrives at decisions whether the threatening armament still constitutes a threat, based on the data that was decoded as said, based on the optical reflections. In case the answer would be positive, then it is still necessary to continue illuminating it, and the system reverts to the arena (see path 231).

Stage 232 prevails from the instant that based on the data of the reflections from the threatening armament, it was ascertained that its trajectory was jammed or disrupted, and it does not constitute a treat any more. At this stage the system returns to its paused state.

In stage 234 the command and control assembly performs "reporting"—for example, recording in its memory a report of the happenings during the encounter with the threatening armament.

Reverting back to FIG. 1, it is to be noted that so far we basically treated the handling of the threatening armament by one end unit, but any professional experienced in this field would also understand that in accordance with the present invention it is possible to be engaged in combating the threatening armament by a continuum of several end units, as the threatening armament is homing and flying through several sectors being watched by a plurality of end units.

Any experienced professional would understand that at this stage, skipping and/or forming a chain of the lasing operations might occur—to the next (adjacent) end unit of the system (for example: 50"), into whose sector (52'), the threatening armament has entered now.

The command and control assembly 35 enables the allocation and directing of a continuous laser energy beams emitted from the laser source 15 to several end units 50 one after the other (i. e., in series), one after the other, in accordance with the variations of the threatening armament's location in relation to the sectorial array 45 of the end units, in a manner that enables to form a continuum of instances of aiming at the threatening armament and releasing a volley of laser beams illuminating the threatening armament by a chain of laser energy beams in series from the several end units 50 one after the other.

For example, as mentioned above, in FIG. 1, there is depicted (using dashed lines) the activating of end unit 50"

from the time that the threatening armament 25 passed by the sector 52 of end unit 50' and arrived at the adjacent sector 52".

Moreover, in FIG. 1, the handling of a single threatening armament 25 is depicted, but any professional experienced in this field would understand that a system in accordance with the present invention enables the handling of several threatening armaments simultaneously by several end units activated in terms of laser illumination, in series—one after the other.

To recapitulate and extend the treatment of the system in accordance with the present invention, we note that the command and control assembly 35 enables continuous handling of a plurality of threatening armaments by selectively providing energy from laser source 15 to the end unit 50 that was selected by the command and control assembly 35 as the most suitable—under the prevailing conditions, to be the end unit pointing at and illuminating one of the threatening armaments that endangers the platform at that specific instant, by emitting the jamming laser beam towards it.

For example, the engaging—at a given real time and space, of one of the threatening armaments that was marked as threatening armament 25 (see FIG. 1) will be attacked by end unit 50', and at another instant (for example, somewhat later), the handling of a different threatening armament 25' by end unit 50''' is described by dashed lines.

Any professional would understand that in a system in accordance with the invention, it is possible to combine some or all the capabilities referred to above, and thus manage to jam several threatening armaments by actuating a continuum of several end units and even return and neutralize a given threatening armament—one that previously, in one selected time spot or another, assigned priority by the command and control assembly 35 as posing a reduced threat in comparison to a new and potential threat that has emerged in the system's arena.

In a scenario presenting the co-existence of a plurality of threatening armaments within a sector in the system's operation arena, the operation of the system is based on extracting the features of the threatening armaments as they are received in the sensors of the end units 50 wherein the threatening armament were detected in their sectors.

The evaluation of the level (intensity) of the threat is based on the outputs of sensor means 75 and on feature extraction of the range to the threatening armament. The range to the threatening armament might be obtained by a direct measurement of the time elapsed from the instant that the lasing started until the reception of the reflection by a dedicated laser detector (for this task) that might be connected to sensor means 75. In addition, feature extraction of the threatening armaments' path (trajectory) might also be executed by measuring the angular data (angular state and rate), line of sight and the radiometric reflections from the threatening armament—and all those, at the time that the threatening armament is being tracked.

Feature extraction of the threatening armaments' path (trajectory) provides the required data to the command and control assembly 35—in order to establish which is the one whose threat looms more immediate and dangerous than the other ones, from those detected in the relevant sectors of the end units, for example by evaluating the time span that would elapse from a given instant until a hit by the threatening armament (of the platform that was assigned to be protected) might materialize (in case the threatening armament would not be attacked by a laser beam).

Hence, as said, the command and control assembly 35 should route the laser energy to the end unit 50 whose in her coverage sector the threatening armament presents the highest (and immediate) level of potential threat.

Let's revert to the example illustrated in FIG. 1. In order to prevent any doubt, let's consider that in case that end unit 50' is handling the potential threat at the highest urgency level, then also in the sector of end unit 50''' there exists a threatening armament 25'—then end unit 50''' continues to send data relating to it to the command and control assembly 35 in a cyclic manner and continues to track the threat in its sector. In case that at a given instant the command and control assembly 35 would estimate that end unit 50''' became the one whose threat level is now higher and imminent, then the laser energy would immediately be diverted to unit 50'''. If at the same time, a threat still exists at the sector of 50' (after the energy has been diverted to end unit 50''', then the tracking of the threat in the sector of 50' will continue simultaneously and its data would also keep flowing to the command and control assembly 35 for evaluating its threat.

This model of handling several targets simultaneously constitutes a marred advantage of a system in accordance with the invention. The time of switching the laser energy between end units is very short and hence enables an efficient use of a single laser source 15.

Reference is being made to FIG. 3. FIG. 3 constitutes a flow chart that describes schematically the manner that system 10 is handling a phase situation in which there is a plurality of threatening armaments in the arena that is the responsibility of system 10 (and see also FIG. 1).

In stage 305 indications announcing the detection of a threatening armament (in the arena)—one or more, are received from the detection and acquisition system 40.

A threat sensing and analysis is executed in stage 310 by the command and control assembly 35.

In stage 315 the command and control assembly 35 arrives at a decision whether there exists a scenario pointing at the possibility that a plurality of threatening armaments are present in the arena.

If the decision is positive (they are there), then—at stage 320 the command and control assembly 35 analyzes the most probable threat in order to decide which one of the threatening armaments possesses the highest potential threat on the platform (the platform that has to be protected by system 10).

In stage 325 the command and control assembly 35 selects an end unit 50' that is the most suiting one for attacking this most threatening armament.

In stage 330 an attack decision is arrived at by command and control assembly 35 whether danger still looms due to the threatening armament.

In stage 335 the command and control assembly 35, based on up to the minute data that are received from end unit 50' regarding the status of the threatening armament that is illuminated by it (including—based also on the reflections that were received by a second sensor means 75), conducts an examination to find whether danger still looms due to the threatening armament In stage 340 the command and control assembly 35 arrives at a decision whether there still exists danger due to the threatening armament—

If the answer is positive, then the command and control assembly 35 commands end unit 50' to continue illuminating the threatening armament (see path 342 in the figure).

If the answer is negative, namely there is no longer danger presented by the threatening armament that was attacked by the laser beam from end unit 50'—then the system reverts to stage 315 (see path 344 in the figure), in order to decide whether there still exists a scenario pointing at the possibility that a plurality of threatening armaments are present in the arena.

From the instant that only one threatening armament was left in the arena, then at stage 315—to which the system 10 reverts at every time that handling a certain threatening armament from the plurality of threats was successfully terminated (see path 344), a decision is made that from now onwards the scenario becomes the case of a solely one threatening armament existing in the arena.

Hence we return to stage 315. This is the stage in which the command and control assembly 35 arrives at a decision whether there exists a scenario pointing at the possibility that a plurality of threatening armaments are present in the arena, but that now again the case is of the existence of a single threatening threat.

Any professional in the field will appreciate that upon existence of a single threat, the flow chart should basically depict the operational sequence as illustrated and described with reference to FIG. 2 hereinabove. Therefore, for clarity and convenience we illustrated it in a rather reduced and skeleton way (see the right branch in FIG. 3 and compare it to its equivalent—FIG. 2).

Stage 350 exists now. In stage 350 the end unit that was selected as the most appropriate (for example, unit 50") attacks the solitary threatening armament in its arena with a laser beam.

In stage 355, based on the updated data that is being received from end unit 50" about the status of the threatening armament that is illuminated by it (inclusive of—based on the reflections as they were received from a second sensor means 75), the command and control assembly 35 conducts an analysis in order to decide whether there still exists danger due to the threatening armament.

In stage 360, a decision is made by the command and control assembly 35 whether there still exists danger due to the threatening armament in the arena—

If the answer is positive, then the command and control assembly 35 commands end unit 50' to continue illuminating the threatening armament (see path 362 in the figure).

If the answer is negative—no threat exists—than the command and control assembly 35 commands the laser source to terminate illumination and the system return to its pause and readiness state (see path 364 in the figure).

Revert to and refer to FIG. 4. FIG. 4 constitutes a schematic illustration of an end unit 50 in system 10 whose arena of operation and its operation scheme are depicted, respectively, in FIGS. 1 and 2.

As said, end unit 50 comprises an optical assembly 55 that is movable, in order to aim and direct laser beam 17 towards the threatening armament as well as to receive self emission and optical reflections 18 from it. End unit 50 also comprises a static assembly 60 that is connected to optical assembly 55.

Optical assembly 55 serves as a beam director module of end unit 50. The optical assembly 55 comprises the following means: a stabilized mirrors assembly 405 that might be tuned to any given range within the FOR of the end unit (the mirrors assembly might include also an inertial equipment and gages for providing the inertial state of the assembly) means 410 that serves to calibrate sensor means 65 and 75 that are installed in static assembly 60 (for example, a means to calibrate means of the FLIR type sensor when the two sensor means 65 and 75 are indeed of this type), gage means 415 for examining the intensity of the laser source, means 420 for testing and calibrating the angular deviation between the axis of the laser beam and the sensor means 65 and 75, and an electronic module 425 that controls, activates and reports on the operational state of optical assembly 55.

Static assembly 60 serves as the optoelectronic module of end unit 50. Static assembly 60 comprises the following means: first sensor means 65 that might be a means to of the FLIR type having a FOV of several degrees, second sensor means 75 that might also be a means to of the FLIR type having a narrower FOV as compared to that of the FOV of sensor means 65, an optomechanical adapter means 430 for integrating the path of the laser beam radiated by the laser source and routing it by an optical path into the static assembly 60, and detector means 433 for measuring the angular deviation of the laser beam while entering adapter means 430 (in order to enable compensation of such deviation through electronic module 425 of optical assembly 55).

The optomechanical adapter means 430 includes optical components (not illustrated) that lead inertial means 435 (or any other navigational means) in order to produce data of the positional and angular state of end unit 50 (e.g.—in terms of angular position, location and angular velocity of end unit 50).

As said, optical assembly 55 is movable, for example in the planes of azimuth and elevation, in a manner that enables centering the appearance of the threatening armament as it is received from sensor means 65 towards the center of the display as it produced from sensor means 65. In the preferred configuration of the invention, the centering is executed by moving stabilized mirror assembly 405.

In the illustrated example, end unit 50 includes also means 415 for measuring the intensity of the laser beam and means 420 for generating relative location data of the laser beam relative to the first and second sensor means 65, 75 and this, in a manner that enables the command and control assembly 35 to execute bore sighting of the direction of the laser beam in relation to first and second sensor means 65, 75 LOS.

Each end unit 50 might include, in addition, means 450 used to provide a self test that actuates measurement means 415 and producing the relative location data by means 420 for performing self calibration and troubleshooting in the aspects of the laser beam and zeroing the laser beam in relation to first and second sensor means 65, 75 LOS.

Thus, a system 10 in accordance with the present invention is a laser based system for protection from attacks by armament equipped with an optical homing head element, that is a modular one considering the aspect of a plurality of end units 50 but simultaneously based on a single energy source (namely laser source 15).

Protecting system 10 enables performing monitoring and examination of the threatening armament in real time domain, based on optical reflections of the impinging laser beam as they are received from the threatening armament during its attacking flight.

Protecting system 10 includes—integrally in each one of its end units 50, embedded means that enable generating control and calibration feedback data (regarding the energy output of the laser and its direction).

System 10 has independent capabilities of measurements and evaluation of the threatening armament trajectory (path), in order to evaluate the level of the threat posed by the specific armament. This is valid for example, in situations of a plurality of threats in the relevant arena and combined with the necessity to provide priorities and cleverly assigned the jamming energy.

In addition, by significantly reducing the number of moving and stabilized assemblies making up the system 10 is as well a reliable system, rugged and made to withstand harsh environmental conditions.

Any professional would understand that the present invention was described above solely in a way of presenting examples, serving our descriptive needs and those changes or variants in the structure of the Laser Based Countermeasures System—the subject matter of the present invention, would not exclude them from the framework of the invention.

In other words, it is feasible to implement the invention as it was described above while referring to the accompanying figures, also with introducing changes and additions that would not depart from the constructional characteristics of the invention, characteristics that are claimed herein under.

The invention claimed is:

1. A laser based system for protecting a platform against an armament equipped with an optical homing head element, that comprises— a command and control assembly equipped with an interface to a detection and acquisition system that detects and locates a threatening armament and receives from it a warning about said detection of said threatening armament combined with data relating to it; and a laser source operable by said command and control assembly in order to produce the required energy for jamming said optical head of said threatening armament; and wherein said system is characterized by that it comprises in addition— a sectarian array of a plurality of end units that are connected unto said laser source for selectively routing laser energy from said source to an end unit that was selected by said command and control assembly as the end unit that is best suited under prevailing conditions for pointing at said threatening armament and attacking it by emitting a laser beam in its direction, wherein each of said end units comprises a beam director module capable of aiming said laser beam towards said threatening armament and receiving optic reflections from it and an optoelectronic module that is connected to said beam director module and comprises a first sensor means covering a sector at which said threatening armament is anticipated, and second sensor means for sensing said returning optical reflections from said threatening armament as they are received after illuminating it by said laser beam, wherein said command and control assembly enables to rout said laser energy from said laser source to several of said end units in series, in accordance with the variations of said threatening armament's location in relation to said sectarian array of said end units, in a manner that enables to form a continuum of instances of aiming at said threatening armament and launching a volley of laser beams illuminating said threatening armament in series from said plurality of end units one after another, and wherein said command and control assembly enables continuous handling of a plurality of threatening armaments by selectively routing energy from said laser source to an end unit that was selected by said command and control assembly as the most suitable under the prevailing conditions, to be the end unit pointing at and illuminating one of said threatening armaments that endangers said platform at that specific instant, with said laser beam.

2. A system in accordance with claim 1, wherein— said first sensor means is a FLIR system.

3. A system in accordance with claim 1, wherein— said first sensor means is operable by said command and control assembly in a timing scheme fixed on a basis of data being received from said detection and acquisition system.

4. A system in accordance with claim 1, wherein— angular deviations if occur between said laser beam direction and said end unit's sensors LOS, are compensatable in real time.

5. A system in accordance with claim 1, wherein— said beam director module is an optical assembly movable in a manner that it enables centering the threatening armament appearance as it is received from said first sensor means towards the center of said sensor FOR.

6. A system in accordance with claim 5, wherein— said optical assembly includes stabilized mirror assembly in order to achieve said centering.

7. A system in accordance with claim 5, wherein— said threatening armament appearance includes a view of its front end wherein said laser beam might be aimed at.

8. A system in accordance with claim 1, wherein— said second sensor means for sensing the returning optical reflections from said threatening armament, is a FLIR system whose sensing sector is narrow relatively to the above cited dimensions of said sector that is provided by said first sensor means, and said second sensor is centered jointly with the direction of said laser beam.

9. A system in accordance with claim 1, wherein— said laser beam includes a plurality of wavelengths wherein each one of them can be modulated.

10. A system in accordance with claim 1, wherein— said second sensor means for sensing said optical reflections returning from said threatening armament is connected to a sensor means in order to receive data relating to said threatening armament.

11. A system in accordance with claim 10, wherein— said data includes at least one item from a group of data consisting of —velocity of said threatening armament, distance to said threatening armament, angle of said threatening armament in relation to said system, variation of angular rate of said threatening armament and an item providing intensity value of said optical reflection from said threatening armament.

12. A system in accordance with claim 11, wherein— said command and control assembly is connected to said sensor means for gathering the data serving to evaluate the trajectory of said threatening armament and arriving at decisions based on said data.

13. A system in accordance with claim 1, wherein— each of said end units, comprises— means for measuring said intensity of said laser beam; and means for generating data providing the location of said laser beam relative to said first sensor means FOR and relative to said second sensor means FOR in a manner that enables said command and control assembly to perform bore sighting of the direction of said laser beam relative to said cited sectors.

14. A system in accordance with claim 1, wherein— said beam director module constitutes a movable optical assembly that comprises— a stabilized mirrors assembly that might be aimed unto every given area within said FOR of said optical assembly; and means for calibrating said first and second sensor means; and a gage means for measuring intensity value of said laser source; and means for examining and calibrating said angular deviation between said axis of said laser beam to said first and second sensor means; and an electronic module that controls, activates and reports on said operational state of said optical assembly; and wherein said optoelectronic module constitutes a static assembly that comprises— said first and second sensor means; and an optomechanical adapter means for integrating said path of said laser beam radiated by said laser source and routing it by an optical path into said static assembly; and wherein said optomechanical adapter means includes optical components in order to lead said laser beam unto said optical assembly while adapting to said axis of field of view of said first and second sensor means; and detector means for measuring the angular deviation of said laser beam while entering said adapter means;

means for producing said angular state of said end units in space; and an electronic module for controlling, activating and reporting said operational state of said static assembly.

15. A method for protecting platforms from threatening armaments equipped with a guided homing head with an optical element, that includes the stages of— defining a threatening arena relative to a platform, in which the appearance of said threatening armament is anticipated; and deploying a sectorial array of a plurality of end units relative to said arena, wherein said end units are all connected with a single laser source in a manner that enables selective routing of said laser energy from said laser source to a selected end unit; and detection of a least one threatening armament in said arena on which said array of end units is assigned; and selecting an end unit that best suits to illuminate said threatening armament from among said other threatening armaments that were detected as said; and allocating said laser energy and routing it to said end units; and illuminating said most (imminent) threatening armament by a laser beam radiated from said end unit in order to jam or disrupt said homing head equipped with said optical element of said threatening armament; and continue illuminating said threatening armament by a laser beam radiated from an adjacent end unit, in series, one after another, in accordance with the variations of said threatening armament location within said arena.

16. A method for protecting in accordance with claim 15, where it includes in addition stages of— sensing said most threatening armament by first sensor means installed in said end unit; and sensing optical reflections of said laser beam as reflected from said most threatening armament by said second sensor installed on said (selected) end unit.

17. A method for protecting in accordance with claim 15, wherein it includes in addition a stage of— centering said threatening armament appearance at said first sensor unto said field of view center.

18. A method for protecting in accordance with claim 15 wherein it includes in addition a stage of— centering the LOS of said first and second sensor means and said laser beam to coincide all of them each one with said others.

19. A method for protecting in accordance with claim 15, wherein it includes in addition a stage of— analyzing data relating to the degree of threat presented by said threatening armament based on said reflections arriving from it.

20. A method for protecting in accordance with claim 15, wherein it includes in addition a stage of— compensating for angular deviations if they occur between said laser beam direction and said end unit's sensors LOS.

* * * * *